United States Patent [19]

Colley, deceased et al.

[11] Patent Number: 4,805,412

[45] Date of Patent: Feb. 21, 1989

[54] KRYPTON SEPARATION

[75] Inventors: Charles R. Colley, deceased, late of Wanstead; by Muriel E. Passant, executrix, Felixstowe, both of United Kingdom

[73] Assignee: BOC Cryoplants Limited, United Kingdom

[21] Appl. No.: 141,691

[22] PCT Filed: May 5, 1987

[86] PCT No.: PCT/GB87/00295

§ 371 Date: Feb. 29, 1988

§ 102(e) Date: Feb. 29, 1988

[87] PCT Pub. No.: WO87/06684

PCT Pub. Date: Nov. 5, 1987

[30] Foreign Application Priority Data

May 2, 1986 [GB] United Kingdom ..... 8610766

[51] Int. Cl.[4] ..... F25J 3/04

[52] U.S. Cl. ..... 62/22; 55/66

[58] Field of Search ..... 62/22; 55/66

[56] References Cited

U.S. PATENT DOCUMENTS

| | | | |
|---|---|---|---|
| 3,609,983 | 10/1971 | Lofredo et al. | 62/22 |
| 3,779,028 | 12/1973 | Schuftan et al. | 62/22 |
| 4,401,448 | 8/1983 | La Clair | 55/66 |
| 4,433,990 | 2/1984 | Olszewski | 62/22 |
| 4,568,528 | 2/1986 | Cheung | 55/66 |
| 4,574,006 | 3/1986 | Cheung | 62/22 |
| 4,647,299 | 3/1987 | Cheung | 55/66 |

FOREIGN PATENT DOCUMENTS

| | | |
|---|---|---|
| 390069 | 3/1933 | United Kingdom . |
| 617457 | 2/1949 | United Kingdom . |
| 1371327 | 10/1974 | United Kingdom . |

*Primary Examiner*—Ronald C. Capossela

*Attorney, Agent, or Firm*—Woodard, Emhardt, Naughton, Moriarty & McNett

[57] ABSTRACT

Air separation, in particular apparatus and method for reducing the loss of krypton and xenon during air separation by cryogenic distillation. The invention provides a method of separating air by cryogenic distillation, including forming a first liquid oxygen stream, and a second liquid oxygen stream having a lower concentration of krypton and xenon than said first stream, withdrawing the second stream as product, and subjecting the first stream to further separation to enrich it in krypton and xenon.

10 Claims, 2 Drawing Sheets

KRYPTON SEPARATION

This invention relates to air separation and in particular to apparatus and method for reducing the loss of krypton and xenon during air separation by cryogenic (low-temperature) distillation.

The separation of air into two main constituents (nitrogen and oxygen) has long been practised. Methods and apparatus employed on a large scale make use of the lower boiling point of nitrogen (77° K.) as compared to that of oxygen (90° K.). Thus from a liquid mixture of nitrogen and oxygen, the nitrogen will boil away preferentially, to be captured as required, the residual liquid being oxygen rich. The residual liquid also contains some trace constituents of the original air, including krypton (boiling point 120° K.) and xenon (boiling point 165° K.). These rare gases both have significant commercial value, for instance for inclusion in electric lamp bulbs and other illuminating devices. The efficient recovery from the oxygen fraction of krypton in particular has been the subject of many studies.

When the oxygen fraction is delivered from the primary air separation plant mainly or wholly in the gas phase, one known method and apparatus is to wash the gaseous oxygen with liquid oxygen having a krypton content below that in equilibrium with the gas phase. The washings are partially concentrated by distillation.

A general disclosure of this approach is that shown in British Patent Specification No. 390,069 (FIG. 2); the washing column 4 and concentrating column 6 are hereinafter termed the primary krypton column. A double column with oxygen recovery is described in U.S. Pat. No. 4,401,448 (La Clair).

The concentration of krypton which can be attained with safety is limited by the desirability of restricting the concentration of accompanying hydrocarbons. The method is suited to producing a partial concentrate having a molar content of 0.1–5% krypton plus associated xenon which is hereinafter termed primary krypton concentrate. This is the first step and a major step toward complete separation of krypton and xenon from the oxygen.

Figure 1:
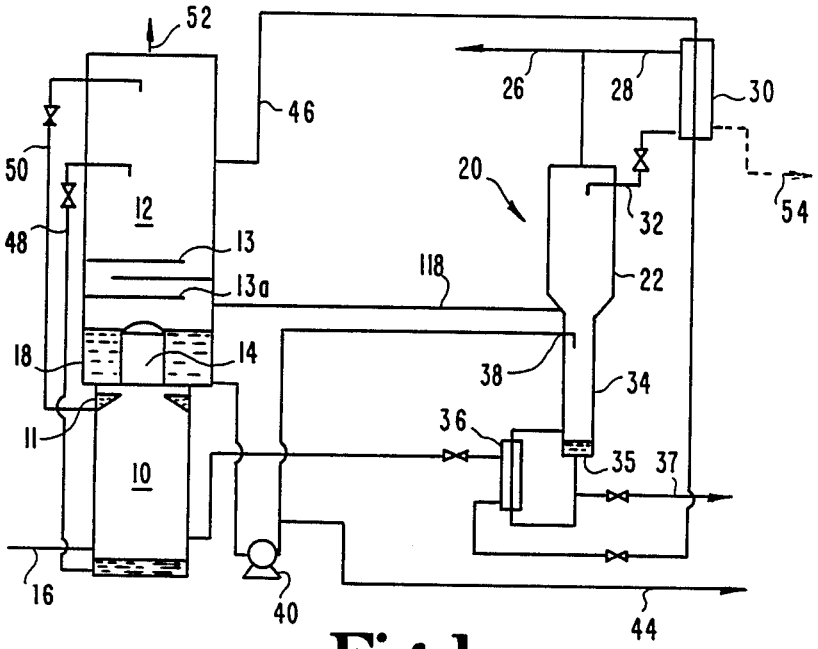
Fig.1 PRIOR ART

A specific embodiment of the known art is shown in FIG. 1. This shows a conventional double column comprising medium-pressure column 10 and low-pressure column 12. A condenser-reboiler 14 is positioned in heat-transfer relationship with both columns; the unit 14, which conventionally is of either the multi-tubular type or the extended-surface type, acts as the main condenser. It will be understood that in alternative embodiments the columns may be positioned alongside each other, with the condenser-reboiler 14 at the head of the column 10 or outside it. Column 12 includes vapour-liquid contacting trays 13.

In use, chilled compressed air enters column 10 through inlet conduit 16. Liquid oxygen containing krypton and xenon collects in the main condenser bath 18 formed around condenser-reboiler 14. Nitrogen vapour from medium-pressure column 10 condenses in unit 14 giving up its latent heat and thereby vaporizing main condenser bath liquid. Waste nitrogen is exhausted at outlet 52 and is preferably passed through heat exchangers. From above the bath 18, vapour is withdrawn through conduit 118 and fed to the primary krypton column 20. Since krypton has a higher boiling point than oxygen, the oxygen vapour contains less krypton than does an equal mass of bath liquid.

The primary krypton column 20 houses trays which effect vapour and liquid contact. Thus vapour from conduit 118 ascends through tray set 22 and in doing so meets descending liquid oxygen which washes out the less volatile xenon and most of the krypton. The now kryptonlean vapour continues to ascend and is then separated into two streams 26,28; stream 26 is removed as gaseous oxygen plant product, after passing through heat exchangers or regenerators, and stream 28 enters cooling condenser 30 where it liquifies and is fed through inlet 32 back into the primary krypton column 20 to provide the aforementioned descending wash liquid.

The washings containing krypton and xenon descend into the lower section 34 and are distilled at almost total reflux and so become more concentrated in krypton and xenon. The sump liquid 35 is withdrawn (intermittently or continuously as required) through conduit 37 as primary krypton concentrate for further concentration and purification by known means.

Heat is supplied at reboiler 36. Condensed heating vapour from the reboiler is used, after expansion, as condenser coolant, evaporating at lower pressure. Any cooling requirement in excess of that effected at the condenser 30 is provided in this arrangement by the injection of a small flow of liquid oxygen through inlet 38 from bath 18 via pump 40. As the liquid oxygen converts to gaseous oxygen its latent heat is taken up.

The unit also includes circuits, 50 and 46 in known fashion. Adsorptive or other devices to remove hydrocarbons may be incorporated at suitable locations.

It will be understood that many variations on this plant layout are possible. The reboiler 36 or the condenser 30 or both may be mounted integrally with the primary krypton column. The column lower section 34 may be positioned alongside instead of underneath the washing section. Furthermore, it has been proposed to lessen or eliminate the operating burden on the main air separation plant by providing reboil and reflux for the primary krypton column by means of a heat pump using, in the closed circuit mode, air or nitrogen as the working fluid. In another known alternative disclosed in British patent specification No. 1 371 327, the heating and cooling is effected by an open circuit heat pump without a reflux condenser and using oxygen as the working fluid.

The refrigeration input through inlet 38 is particularly required when the reboiler is heated by vapour free from entrained liquid and the resultant condensate is expanded for use as condenser coolant.

It is a disadvantage of the known method and apparatus, such as that described with reference to FIG. 1, that if the liquid oxygen produced by the main plant and drawn from column 12 exceeds that required to satisfy the refrigeration needs of the primary krypton column 20, then the krypton and xenon in the liquid oxygen withdrawn through conduit 44 escape recovery. Furthermore this proportional loss is accentuated because the krypton is at higher concentration in the bath liquid than in the gaseous oxygen evolved from it.

As example, the distribution of krypton in the oxygen leaving the main condenser bath calculates out as given in Table 1 assuming that the vapour and liquid are in equilibrium and the vapour has one-tenth the krypton content of the liquid, i.e. the equilibrium constant $K=1/10$.

TABLE 1

| Distribution of Krypton between Gaseous & Liquid Oxygen leaving Main Condenser | | | | | | |
|---|---|---|---|---|---|---|
| Liquid as % of oxygen make | 0 | 2 | 4 | 6 | 8 | 10 |
| % of krypton in liquid oxygen | 0 | 16.9 | 29.4 | 39.0 | 46.5 | 52.6 |

Xenon, being less volatile than krypton, has still less tendency to vaporize into the gaseous oxygen product stream and an even higher percentage is contained in liquid drawn from the condenser bath.

To recover these rare gases liquid oxygen withdrawn through conduit 44 could be redistilled in suitable extra plant. Alternatively apparatus size and heat and fluid flows could be increased to permit the introduction into primary krypton column 20 through inlet 38 of all the liquid withdrawn from bath 18 so as to form extra condensate at condenser 30 from stream 28. After removal of the necessary wash liquid (the aforementioned descending liquid oxygen), the remainder could be withdrawn through conduit 54, as distilled krypton-lean liquid oxygen product.

It is an object of the present invention to provide a method and apparatus to reduce the loss of krypton and xenon in liquid oxygen withdrawn as plant product, without the need for redistillation.

Thus, according to one feature of the present invention, plant product is withdrawn from a lower tray of the low-pressure column, in particular the bottom tray.

According to a further feature of the present invention, collector means are provided at a tray of the low-pressure column, in particular the bottom tray, the collector means delivering to a liquid oxygen product conduit.

In an alternative installation, with the low-pressure column 12 mounted alongside medium-pressure column 10, the liquid oxygen withdrawn as product can be taken from the liquid stream transferring from the low-pressure column to the main condenser. Thus the liquid oxygen is again withdrawn prior to the reboiling step and the resulting concentration of the krypton and xenon in the main condenser bath. If desired the reboiler 14 can be positioned outside the low-pressure column. Thus according to another feature of the invention I propose a method of reducing loss of krypton and xenon in liquid oxygen obtained from air separation which includes withdrawing liquid oxygen product from a position between the low-pressure column and the condenser-reboiler.

Figure 2:
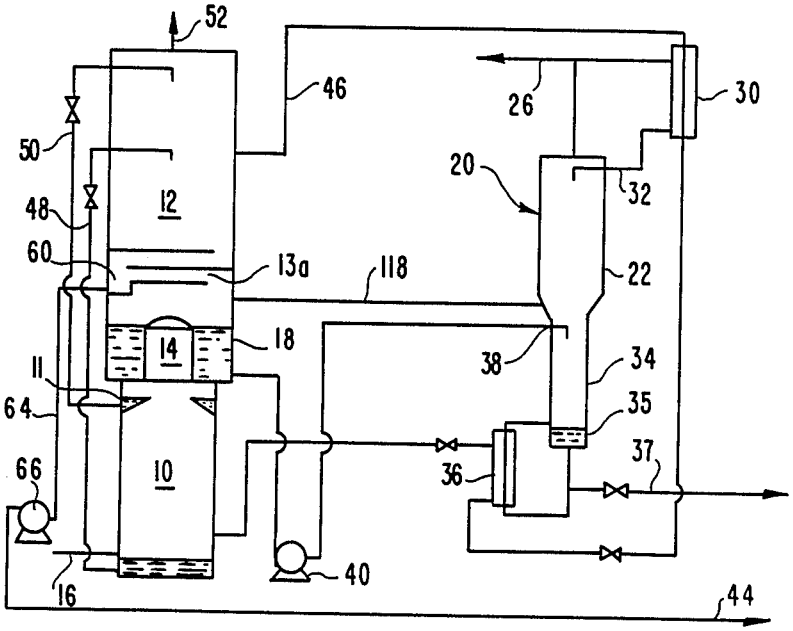
Figure 3:
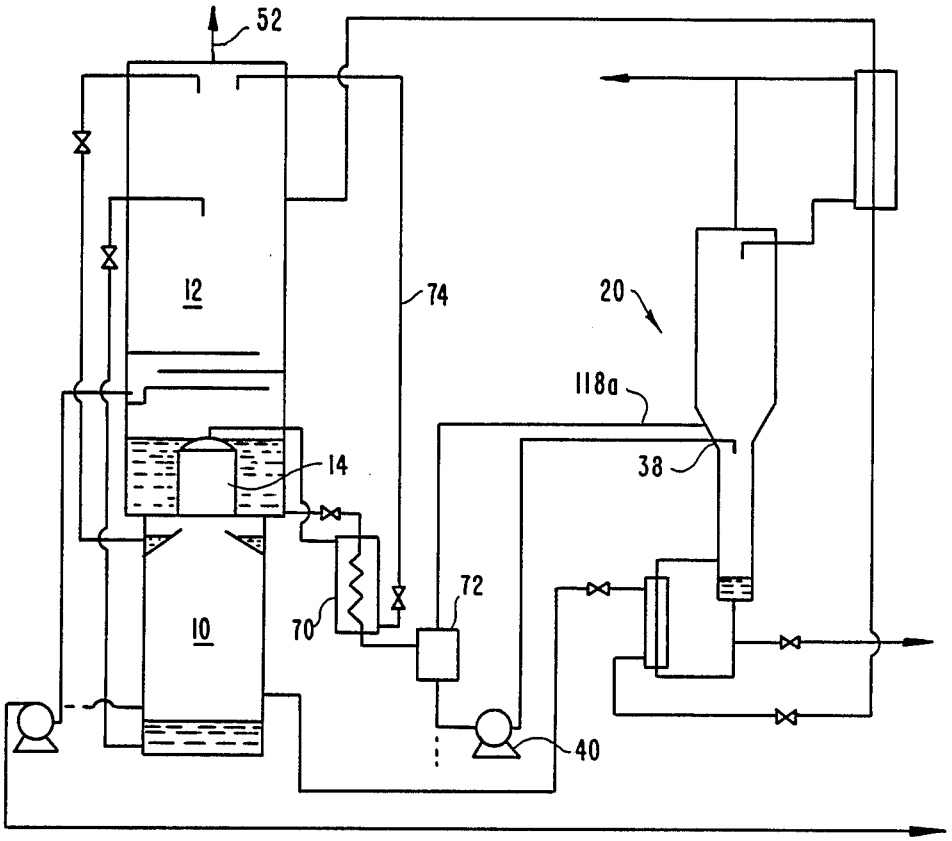

The invention will be described by way of example with reference to the accompanying drawings, in which FIG. 1 is a prior art embodiment, shown schematically;

FIG. 2 is one embodiment of air separation apparatus, with reduced krypton loss, according to the invention; and FIG. 3 is an alternative embodiment.

In the drawings, similar numerals are used to designate similar parts.

In the arrangement of FIG. 2, collector 60 is positioned to receive liquid mix, primarily liquid oxygen, from the lowest tray 13*a* of the trays 13. Collector 60 is connected by conduit 64 to pump 66 and thus to conduit 44 to deliver the liquid oxygen product. This product can, if desired, receive known further treatment such as filtration, hydrocarbon removal and/or undercooling.

By withdrawing the liquid oxygen required as plant product from a tray 13, in particular the bottom tray 13*a*, less krypton and xenon is taken than when drawing the same volume from bath 18.

Thus instead of liquid oxygen destined for product being withdrawn via pump 40 from main condenser bath 18, it is withdrawn separately from a tray 13 e.g. 13*a* (or from an internal duct or ducts receiving liquid directly from a tray). In selecting the position of collector 60 in relation to the trays 13 and bath 18, account will be taken of the vapour content of the liquid mix.

Thus I propose a modified installation having a triple-offtake of oxygen (i.e. a mix principally of oxygen) from the low-pressure column 12, namely (a) gaseous oxygen through conduit 118 to primary krypton column 20 for extraction of its krypton and xenon content;

(b) liquid oxygen from the main condenser bath 18 via pump 40 for extraction of its krypton and xenon content;

(c) liquid oxygen from a tray 13, e.g. lowest tray 13*a*, for withdrawal as product without krypton or xenon recovery.

The improvement will now be described in relation to an air separation unit having an hourly net input of 33000 $m^3$ of dry air. This air will typically contain 37.6 liters krypton and 2.8 liters xenon, all gas volumes being measured at the same temperature and pressure. An oxygen yield of 19% will give 6270 $m^3$ oxygen (100% basis). In the steady state and neglecting any loss of krypton and xenon en route, the oxygen leaving the main condenser will contain 6.0 volumes per million (vpm) krypton and 0.45 vpm xenon if in homogeneous form, i.e. all gas or all liquid.

If $7\frac{1}{2}$% of the oxygen is withdrawn from the main condenser in liquid form and the vapour has one-tenth the krypton content of the liquid, the gaseous oxygen will contain 3.58 vpm krypton and the liquid oxygen 35.8 vpm. Allowing for $1\frac{1}{2}$% of the total oxygen to be fed as liquid to the primary krypton column for cold balancing, the 13.5 liters in the other 6% escape recovery.

If the liquid and vapour leaving the bottom tray are in equilibrium in respect of krypton content (i.e. 100% tray efficiency) then the liquid will contain less than 5 vpm krypton. Thus by withdrawing product from liquid on or leaving the bottom tray the hourly quantity of krypton escaping recovery treatment will be less than 1.9 liters. Instead of 36% of the krypton escaping recovery treatment, withdrawal of liquid product at the bottom tray instead of from the main condenser bath will reduce krypton escaping recovery treatment to less than 5% of the total krypton reaching the lower part of the low-pressure column.

If liquid is instead withdrawn from the second tray above the main condenser and each tray acts as an equilibrium stage, the liquid oxygen product will contain less than $2\frac{1}{2}$% vpm krypton and less than 1 liter of krypton will escape recovery treatment.

Since xenon is less volatile than krypton, withdrawal of liquid oxygen product from a low tray instead of from the main condenser bath will reduce xenon escaping recovery treatment by even more when expressed in percentage terms for the example conditions.

If aspirated krypton and xenon are lost before reaching the lower part of the low-pressure column the savings in liter terms will of course be smaller.

The liquid oxygen fed to column 20 through inlet 38 helps to keep the main condenser bath purged of impurities less volatile than oxygen.

My improved method is also applicable to an air separation plant in which oxygen destined for gaseous product is vaporized not in the main condenser bath but in a supplementary condenser outside the double column. A plant of this type is illustrated in FIG. 139 of Ruhemann: "The Separation of Gases", Oxford University Press (1949).

Avoiding the use of expanded high-pressure air to heat the vaporizer (reboiler) and disregarding means of hydrocarbon removal, the same technique of krypton recovery as in FIG. 2 can be applied. This leads to the circuit shown in FIG. 3.

The supplementary condenser 70 is heated by nitrogen vapour from medium-pressure column 10 and vaporizes most of the liquid oxygen withdrawn from condenser bath 18. The formed gaseous oxygen passes by way of separator 72 and conduit 118*a* to primary krypton column 20 as in the known art. The small flow of liquid oxygen mix leaving supplementary condenser 70 can be fed to primary krypton column 20 as a cold-balancing stream by way of separator 72, pump 40 and inlet 38. Alternatively, as in the known art, all or part can be rejected from separator 72 to remove from the plant hydrocarbons and other impurities less volatile than oxygen.

As all the product oxygen in the FIG. 3 embodiment leaves the double column in substantially liquid form its krypton and xenon content are relatively low. Nevertheless, in terms of krypton and xenon escaping recovery, there is still advantage in withdrawing liquid oxygen product from a low tray of column 12 instead of from the main condenser bath. The krypton content of liquid oxygen withdrawn from a low tray e.g. 13*a* could be in the region of 2 vpm as compared with about 6 vpm in the main condenser bath.

The advantage of the FIG. 2 proposal lies in the increase in output of krypton and xenon in the form of primary concentrate, at a given rate of oxygen withdrawal as liquid product, for virtually the same hourly energy input.

If, in the FIG. 1 process, liquid oxygen product is not taken direct from the delivery of pump 40 but is withdrawn (through conduit 54) as krypton-lean distillate, the advantage of FIG. 2 then principally lies in avoiding energy-greedy distillation of liquid oxygen product and the resultant operating burden which this imposes on the main air separation unit.

It will thus be appreciated that during the separation of oxygen from air by cryogenic distillation combined with recovery of krypton from the gaseous oxygen product I propose the step of withdrawing as a product without recovery of its krypton fraction liquid oxygen from a position in the main distillation column where the liquid oxygen has a krypton content lower than that of the liquid oxygen in the main condenser.

It will be understood that in operation liquid collects in the annular trough 11 near the top of medium-pressure column 10.

We claim:

1. A method of separating air by cryogenic distillation, comprising the steps of:

forming a first liquid oxygen stream having a first krypton concentration;

thereafter forming a second liquid oxygen stream from condensed vapor of said first liquid oxygen stream, said second liquid oxygen stream having a lower concentration of krypton than said first stream;

flowing said first liquid oxygen to means for subjecting the first stream to further separation to enrich it in krypton; and withdrawing the second liquid stream after formation thereof as product having a reduced krypton concentration through a product line.

2. A method as claimed in claim 1, in which the first stream is taken from the liquid phase in a liquid oxygen reboiler associated with a distillation column in which the air is separated.

3. A method as claimed in claim 2, in which the reboiler is located in the sump of the distillation column and the second stream is taken from liquid-vapour contacting means above the reboiler in the column.

4. A method as claimed in claim 3, in which a gaseous oxygen stream is withdrawn from the vapour phase in the reboiler and is subjected to further separation.

5. A method as claimed in claim 3 or claim 4, in which said liquid-vapour contacting means comprises a plurality of spaced, horizontal liquid-vapour contacting trays, and the second stream is withdrawn from the bottom tray.

6. A method as claimed in claim 2, in which the reboiler is heated outside the distillation column.

7. Apparatus for separating air including:

a first distillation column having means for holding a first liquid oxygen stream with a first concentration of krypton, and further having means for collecting from condensed vapor of the first stream a second liquid oxygen stream with a lower concentration of krypton than the first stream;

a first outlet from said means for holding a first liquid oxygen stream in communication with a second distillation column for separating the first stream to enrich it in krypton; and a second outlet from the means for collecting a second liquid oxygen stream, the second outlet communicating with a product line for withdrawal of the second stream as product having a reduced krypton concentration.

8. Apparatus as claimed in claim 7, additionally including a sump in the first distillation column, wherein the outlet for the first liquid oxygen stream communicates, in use, with the liquid in the sump, and the outlet for the second liquid oxygen stream communicates with liquid-vapour contacting means in the first column.

9. Apparatus as claimed in claim 8, in which said liquid vapour contacting means comprises a plurality of spaced, horizontal liquid-vapour contacing trays and the outlet for the second stream communicates with the bottom tray.

10. Apparatus as claimed in claim 8 or claim 9, additionally including a third outlet for gaseous oxygen from the sump of the first column, said third outlet communicating with the second column.

* * * * *